US007041017B1

(12) United States Patent
Carfo

(10) Patent No.: US 7,041,017 B1
(45) Date of Patent: May 9, 2006

(54) SWING MASTER

(76) Inventor: Sylvio Carfo, 5622 N. Vicker Ave., Chicago, IL (US) 60646

( * ) Notice: Subject to any disclaimer, the term of this patent is extended or adjusted under 35 U.S.C. 154(b) by 158 days.

(21) Appl. No.: 10/640,062

(22) Filed: Aug. 14, 2003

(51) Int. Cl.
*A63B 69/00* (2006.01)

(52) U.S. Cl. ..... 473/457; 473/422

(58) Field of Classification Search ..... 473/457, 473/422, 437, 169, 588–568, 170, 44–51, 473/308, 310, 318, 296, 564; 463/47.5–47.7, 463/47.1, 47.2; 416/63; 434/365; 29/428
See application file for complete search history.

(56) References Cited

U.S. PATENT DOCUMENTS 3,104,876 A * 9/1963 Salsinger ..... 473/568
3,246,894 A 4/1966 Salisbury
3,353,824 A 11/1967 Hanson, Jr.
3,554,545 A 1/1971 Mann
4,622,017 A * 11/1986 McGraw ..... 440/101
5,152,533 A * 10/1992 Radakovich ..... 473/206
5,215,307 A * 6/1993 Huffman ..... 473/409
5,772,523 A * 6/1998 Sheftic ..... 473/227
D397,385 S 8/1998 LaBorde et al.
5,795,201 A * 8/1998 Tibbetts ..... 440/101
6,022,255 A * 2/2000 Lukanovich ..... 440/101
6,482,113 B1 * 11/2002 Finn ..... 473/551

* cited by examiner

*Primary Examiner*—Eugene Kim
*Assistant Examiner*—M. Chambers
(74) *Attorney, Agent, or Firm*—Patent & Trademark Services, Inc.; Joseph H. McGlynn

(57) ABSTRACT

A training aid for teaching batters how to swing properly. The aid resembles a baseball bat which has a front portion which has been flattened, and an angled device has been attached to the handle. The angled portion has a flat portion which is not quite parallel with the flat portion on the front of the bat.

7 Claims, 2 Drawing Sheets

1
3
5
6
10
11

SWING MASTER

BACKGROUND OF THE INVENTION

This invention relates, in general, to a baseball training aid, and, in particular, to a baseball training aid which helps instruct batters in the proper method of swing a bat.

DESCRIPTION OF THE PRIOR ART

In the prior art various types of batting aids have been proposed. For example, U.S. Pat. No. 3,353,824 to Hamson, Jr. discloses a batting device which has an attachment that secures to a player's knuckles to remind him to swing level.

U.S. Pat. No. Des. 397,385 to LaBorde et al discloses a baseball training bat which has a flat portion on the front of the bat.

U.S. Pat. No. 3,554,545 to Mann et al discloses a baseball training bat which has a handle section which is curved with respect to the remainder of the bat to facilitate gripping.

U.S. Pat. No. 3,246,894 to Salisbury discloses a variety of baseball training bats, one of which has a flat front portion.

SUMMARY OF THE INVENTION

The present invention is directed to a training aid for teaching batters how to swing properly. The aid resembles a baseball bat which has a front portion which has been flattened, and an angled device has been attached to the handle. The angled portion has a flat portion which is not quite parallel with the flat portion on the front of the bat, but is offset approximately 20–30 degrees.

It is an object of the present invention to provide a new and improved baseball training aid for teaching hitters how to swing properly.

It is an object of the present invention to provide a new and improved baseball training aid which can be easily applied to a variety of bats.

It is an object of the present invention to provide a new and improved baseball training aid which can be secured to an existing bat.

These and other objects and advantages of the present invention will be fully apparent from the following description, when taken in connection with the annexed drawings.

DESCRIPTION OF THE PREFERRED EMBODIMENT

Figure 1:
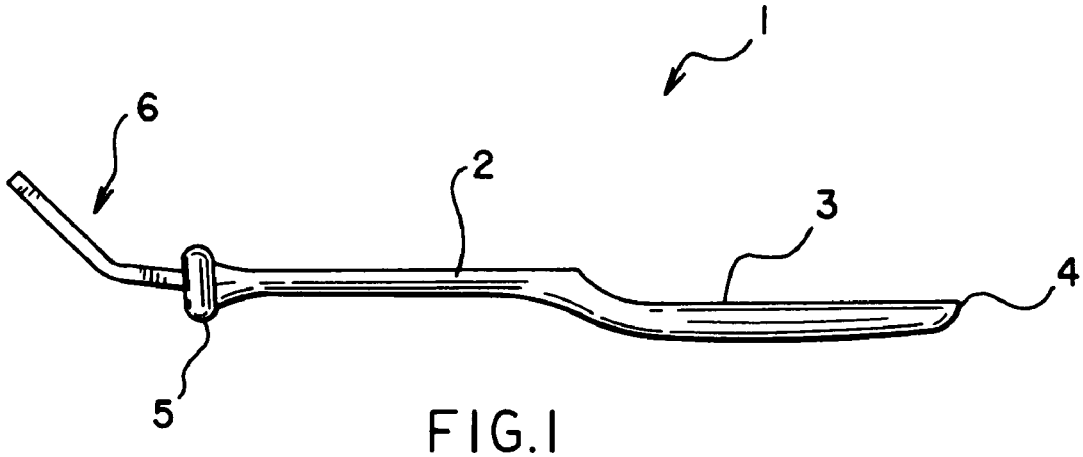
FIG. 1 is a side view of the present invention.

Referring now to the drawings in greater detail, FIG. 1 shows a side view of the present invention 1. As shown in FIG. 1, the present invention 1 is a unitary element that is made from any suitable material such as, but not limited to, wood or plastic. The invention resembles a baseball bat 2 which has a flat portion 3 at one end 4 and a knob 5 at the opposite end. The flat portion 5 represents what would normally be the trademark on the bat. The flat portion 5 extends approximately 13 inches in length, and extends along the longitudinal axis of the front portion of the bat.

Although 13 inches is the preferred length of the flat portion 3 other dimensions can be used without departing from the scope of the invention. A flat plane indicator 6 is secured to the end of the bat adjacent the knob 5.

Figure 2:
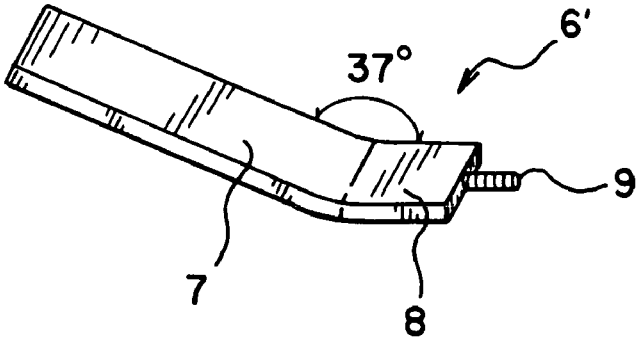
FIG. 2 is a perspective view of one element of the present invention.

FIG. 2 shows a variation of the flat plane indicator 6' which can be attached to the handle of an existing wood bat. The flat plane indicator 6' is the same as the indicator 6 except the indicator 6 is made unitary with the bat, while the indicator 6' is a separate piece which is attached to the handle of the bat to make it integral with the bat. The indicator 6' has a first section 8 and a second section 7. The first section 8 extends at an angle of approximately 37 degrees with respect to the second section 7. Secured to the end of section 8 is a threaded post 9. The threaded post 9 can be used to thread the indicator 6' into an aperture made in the handle of a bat. In this way the flat plane indicator 6' can be attached to an existing wooden baseball bat.

The dimensions of the flat plane indicator are approximately 4 inches long, ¼ inch thick and ¾ inch wide for section 7, and 1 inch long, ¼ inch thick and ¾ inch wide for section 8, although these dimensions can be changed without departing from the scope of the invention.

Figures 3, 4, 5:
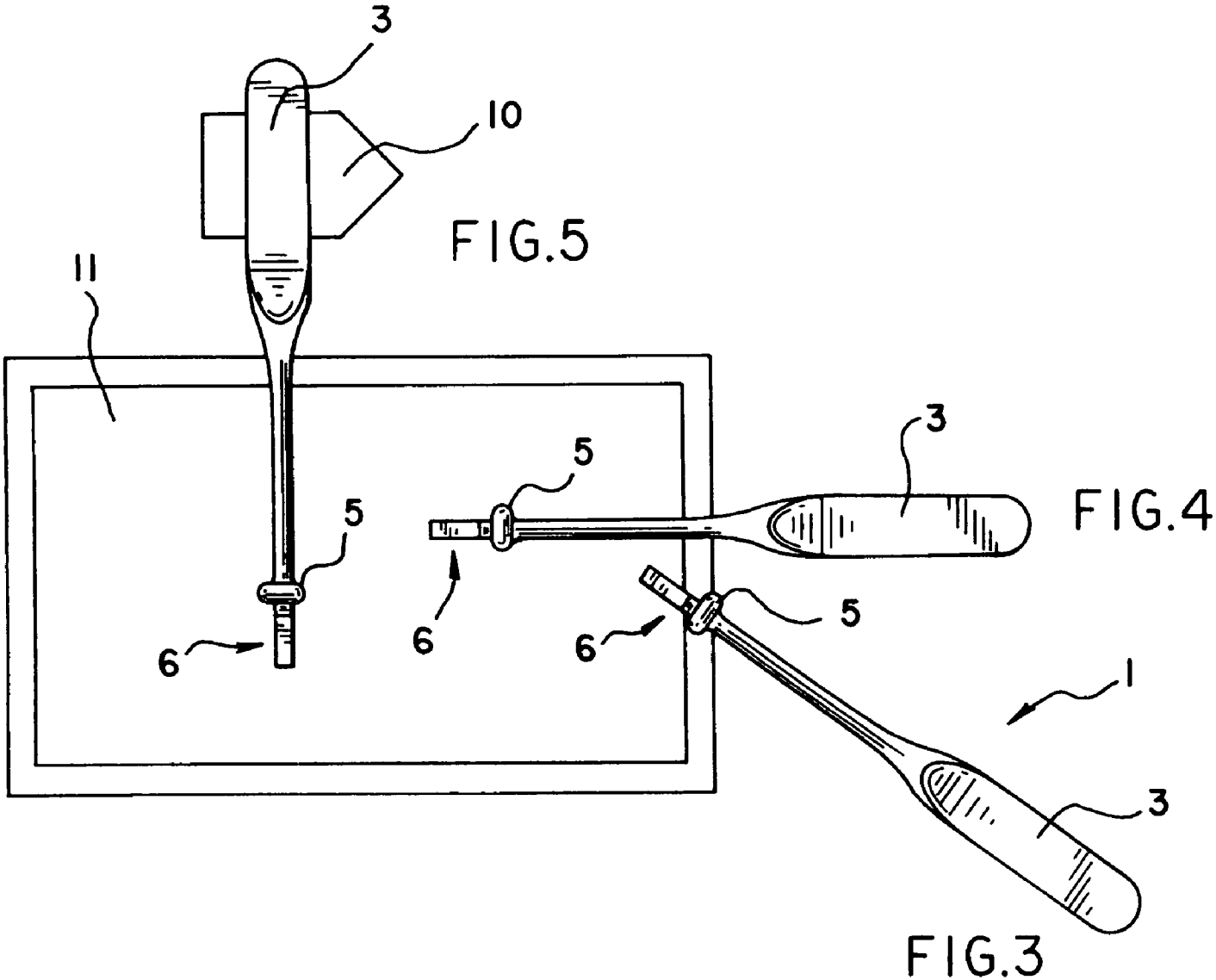
FIGS. 3–5 show the present invention in three positions during a proper swing with respect to home plate and the batters box.

FIGS. 3–5 show the use of a bat having the present invention applied thereto. It should be noted that the person swinging the bat has been removed from these figures for clarity. FIG. 3 shows the bat as it will be held by the user prior to the user making a swing. The knob 5 and the flat plane indicator 6 will be held so they point toward the line of the batters box 11 that is closer to home plate 10. The user can see the flat portion 3 and will hold the bat so this portion 3 is parallel with the ground. The flat plane indicator is another visual aid to the user which will help him/her hold the bat level and swing the bat level. The user can line up the flat plane indicator 6 which is close to him/her with the flat portion 3 and insure that the bat is being held parallel with the ground. The angled portion of the indicator will position the portion 7 up and out of the way from the batter's wrist during the swing.

As shown in FIGS. 4 and 5, as the batter swings the bat, the flat portion of the bat can be seen through the entire swing. Also, the flat plane indicator 6 can be felt between the batter's wrist. Both of these are indicators which if used, will develop muscle memory so a user will create a level swing and develop proper hand placement on the bat. As the bat crosses home plate 10 with the flat portion 3 facing up the user will see that he/she has made a level swing and that their hand placement is proper.

When the user assumes his/her stance, as shown in FIG. 3, the bat knob and flat plane indicator are pointed toward the front line of the batters box 11 (i.e. the line closest to home plate 10). The knob 5 of the bat should be held belt buckle high. From this point the arms start to swing, the front hip opens and the back hip drives into the flat plane of the bat as it is swung toward the ball.

Although the Swing Master and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

I claim:

1. A baseball training aid comprising:

a bat, said bat having a first end and a second end, said bat being circular in cross-section adjacent said second end, and said bat having a truncated section adjacent said first end, said truncated section forming a flat portion extending from said first end toward said second end, said flat portion being a unitary portion of said bat and extending only along one side of said bat, and said flat portion extending along a longitudinal axis of said bat, said bat having a flat plane indicator extending from said second end, and wherein said flat plane indicator comprises a first section and a second section, said first section being closely adjacent said second end of said bat, and said second section being remote from said second end of said bat, and wherein said second section extends at an angle from said first section.

2. The baseball training aid as claimed in claim 1, wherein said bat and said flat plane indicator are unitary.

3. The baseball training aid as claimed in claim 1, wherein said bat and said flat plane indicator are integral.

4. The baseball training aid as claimed in claim 1, wherein said flat plane indicator comprises a first section and a second section, said first section being closely adjacent said second end of said bat, and said second section being remote from said second end of said bat, said first section having means for attaching said flat plane indicator to said bat.

5. The baseball training aid as claimed in claim 4, wherein said means for attaching said flat plane indicator to said bat is a threaded post.

6. The baseball training aid as claimed in claim 1, wherein said angle is less than 90 degrees.

7. A baseball training aid comprising:

a bat, said bat having a first end and a second end, said bat being circular in cross-section from said second end to said first end except for a truncated section adjacent said first end, said truncated section forming a flat portion extending from said first end toward said second end, said flat portion being a unitary portion of said bat and extending only along one side of said bat, and said flat portion extending along a longitudinal axis of said bat, said bat having a flat plane indicator extending from said second end, and wherein said flat plane indicator comprises a first section and a second section, said first section being closely adjacent said second end of said bat, and said second section being remote from said second end of said bat, and wherein said second section extends at an angle from said first section.

* * * * *